US006940045B2

(12) United States Patent
Sanpei et al.

(10) Patent No.: US 6,940,045 B2
(45) Date of Patent: Sep. 6, 2005

(54) HEAT ROLLER AND METHOD OF FABRICATING THE SAME

(75) Inventors: Koichi Sanpei, Kawasaki (JP); Mitsuhiro Mori, Kawasaki (JP); Masatoshi Kimura, Kawasaki (JP); Masao Konishi, Kawasaki (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 10/739,221

(22) Filed: Dec. 19, 2003

(65) Prior Publication Data

US 2004/0149710 A1 Aug. 5, 2004

Related U.S. Application Data

(63) Continuation of application No. PCT/JP02/05444, filed on Jun. 3, 2002.

(51) Int. Cl.[7] ..... G03G 15/20
(52) U.S. Cl. ..... 219/216; 399/333
(58) Field of Search ..... 219/216, 469; 399/330–333; 492/46; 432/60, 228

(56) References Cited

U.S. PATENT DOCUMENTS 5,932,125 A * 8/1999 Kawata et al. ..... 219/216
6,289,198 B1 * 9/2001 Kawamura et al. ..... 399/333

FOREIGN PATENT DOCUMENTS

| | | | |
|---|---|---|---|
| JP | 08146803 A | * | 6/1996 |
| JP | A 9-237671 | | 9/1997 |
| JP | A 10-228201 | | 8/1998 |
| JP | 11058552 A | * | 3/1999 |
| JP | A 2001-74173 | | 3/2001 |
| JP | A 2001-134124 | | 5/2001 |
| JP | A-2003-029559 | | 1/2003 |

* cited by examiner

*Primary Examiner*—Joseph Pelham
(74) *Attorney, Agent, or Firm*—Oliff & Berridge, PLC

(57) ABSTRACT

A heat roller has a cylindrical sheet-like heating element, an inner tube and an outer tube. The sheet-like heating element has a resistance member embedded into an insulating member. The outer tube has a non-linear shape seen in an axial direction. The heat roller is fabricated by supplying pressurized fluid to the inner tube for expanding the inner tube, sheet-like heating element and outer tube toward a die. The die has a non-linear inner shape seen in the axial direction. Therefore, the outer tube of the fabricated heat roller has a non-linear shape. Further, an edge section of the inner tube can simultaneously be formed into a desired shape.

5 Claims, 10 Drawing Sheets

HEAT ROLLER AND METHOD OF FABRICATING THE SAME

CROSS-REFERENCE TO RELATED APPLICATIONS

This application is a continuation of PCT/JP02/05444, filed on Jun. 3, 2002, the contents being incorporated therein by reference.

TECHNICAL FIELD

The present invention relates to a heat roller and a method of fabricating the same. In particular, the present invention relates to, for example, a heat roller suitable for use in a fixing device used in an electrophotographic device.

BACKGROUND ART

An electrophotographic device (copying machine, facsimile device, printer and the like) has an image forming device and a fixing device for fixing an image formed and transferred onto a sheet by the image forming device. The fixing device includes a heat roller.

A heat roller is formed of a metallic ring member, rubber covering the metallic ring member and a halogen lamp arranged inside the metallic ring member. However, the halogen lamp is low in thermal efficiency, and moreover, the rubber covering the metallic ring member reduces the thermal efficiency. In addition, it takes several ten seconds to several minutes to reach a predetermined temperature, so that a preheating is required during a stand-by period.

Recently, there has been developed a directly-heated heat roller including a sheet-like heating element in which a resistance member is embedded in an insulating member. This heat roller has high thermal efficiency, since the resistance member generates heat when electric current flows through the resistance member and the heat is conducted thereby to heat a sheet directly. The sheet-like heating element is at first formed as a flat heating sheet. The heating sheet is rounded to form a cylindrical sheet-like heating element. The sheet-like heating element cannot keep its cylindrical shape with this state, so that it is attached on an inner surface of a metallic cylindrical tube for use. However, attaching the sheet-like heating element onto the inner surface of the cylindrical tube is difficult work.

Therefore, a method for fabricating a heat roller has been proposed wherein a cylindrical sheet-like heating element is sandwiched between an inner tube and an outer tube that compose a duplex tube. Firstly, the inner tube is arranged on the inner surface side of the cylindrical sheet-like heating element, and then, the outer tube is arranged on the outer surface side of this heating element. Then, pressurized fluid is supplied to the inner tube to expand the inner tube and the sheet-like heating element toward the outer tube, whereby the sheet-like heating element is brought into intimate contact with the inner tube and the outer tube. In this fabrication process, it is unnecessary that the sheet-like heating element is brought into contact with the inner tube and with the outer tube, thereby providing a simple assembling operation. After a heat roller including the sheet-like heating element is manufactured in this way, the surface of the heat roller is finished to have a desired shape with a turning machine. If the heat roller is used in the fixing device, for example, the surface of the heat roller is desired to be finished into a reverse-crown shape. Further, a convex section or a concave section is provided at the edge section of the heat roller in order to attach the heat roller to a shaft, or a gear is attached.

SUMMARY OF THE INVENTION

In view of the problems noted above, the present invention aims to provide a heat roller including a sheet-like heating element, an inner tube and an outer tube and capable of being easily manufactured into a desired shape.

A heat roller according to the present invention includes a cylindrical sheet-like heating element having a resistance member embedded in an insulating member, an inner tube that comes in intimate contact with an inner surface of the sheet-like heating element and an outer tube that comes in intimate contact with an outer surface of the sheet-like heating element, wherein the outer tube has a non-linear shape seen in an axial direction.

The heat roller according to the present invention can be used, for example, in a fixing device, has high thermal efficiency and can relatively simply be fabricated. The outer tube is preferably formed into a reverse-crown shape seen in the axial direction.

A method of fabricating a heat roller, according to the present invention, including a cylindrical sheet-like heating element having a resistance member embedded in an insulating member, an inner tube that comes in intimate contact with the inner surface of the sheet-like heating element and an outer tube that comes in intimate contact with the outer surface of the sheet-like heating element, is such that the inner tube is arranged on the inner surface side of the sheet-like heating element, the outer tube is arranged on the outer surface side of the sheet-like heating element, the inner tube, sheet-like heating element and outer tube are inserted into a die having a non-linear inner shape seen in the axial direction, pressurized fluid is supplied to the inner tube to expand the inner tube, sheet-like heating element and outer tube toward the die for forming the outer tube so as to match with the inner shape of the die.

In this way, the heat roller having, for example, a reverse-crown shape can easily be fabricated.

Moreover, a method of fabricating a heat roller, according to the present invention, including a cylindrical sheet-like heating element having a resistance member embedded in an insulating member, an inner tube that comes in intimate contact with an inner surface of the sheet-like heating element and an outer tube that comes in intimate contact with an outer surface of the sheet-like heating element, is such that the inner tube is arranged on the inner surface side of the sheet-like heating element, the outer tube is arranged on the outer surface side of the sheet-like heating element, the inner tube, sheet-like heating element and outer tube are inserted into a die having a convex section or a concave section at its edge section, pressurized fluid is supplied to the inner tube to expand the inner tube, sheet-like heating element and outer tube toward the die for forming the edge section of the inner tube into a shape having a convex section or a concave section corresponding to the convex section or the concave section of the die.

In this way, a heat roller to which, for example, a bearing or gear can be provided can easily be fabricated.

Moreover, a method of fabricating a heat roller, according to the present invention, including a cylindrical sheet-like heating element having a resistance member embedded in an insulating member, an inner tube that comes in intimate contact with an inner surface of the sheet-like heating element and an outer tube that comes in intimate contact with an outer surface of the sheet-like heating element, is such that the inner tube is arranged on the inner surface side of the sheet-like heating element, the outer tube is arranged on the outer surface side of the sheet-like heating element, the inner tube, sheet-like heating element and outer tube are inserted into a die, a ring member is arranged at an edge section of the inner tube, pressurized fluid is supplied to the inner tube to expand the inner tube, sheet-like heating element and outer tube toward the die for forming the edge section of the inner tube so as to match with the inner shape of the die and the ring member is fixed to the edge section of the inner tube.

In this way, a heat roller having a ring member provided thereto can easily be fabricated.

BRIEF DESCRIPTION OF THE DRAWINGS

Preferred embodiments of the present invention will be described in detail based on the followings, wherein.

BEST MODE FOR CARRYING OUT THE INVENTION

Figure 1:
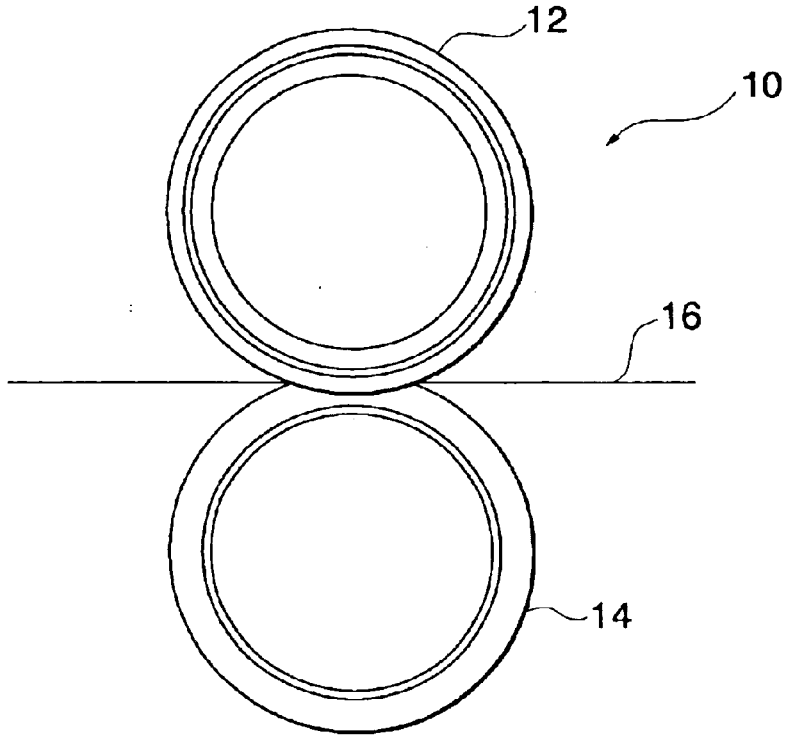
FIG. 1 is a side view showing one example of a fixing device including a heat roller according to the present invention.

FIG. 1 is a side view showing a fixing device including a heat roller according to one embodiment of the present invention. A fixing device 10 includes a heat roller 12 and a pressure roller 14 that is pressed into contact with the heat roller 12 and is covered with rubber. A sheet 16 is transported between the heat roller 12 and the pressure roller 14, whereupon toner carried by the sheet 16 is melted by heat generated by the heat roller 12 and is pressurized between the heat roller 12 and the pressure roller 14, to thereby be fixed.

Figure 2:
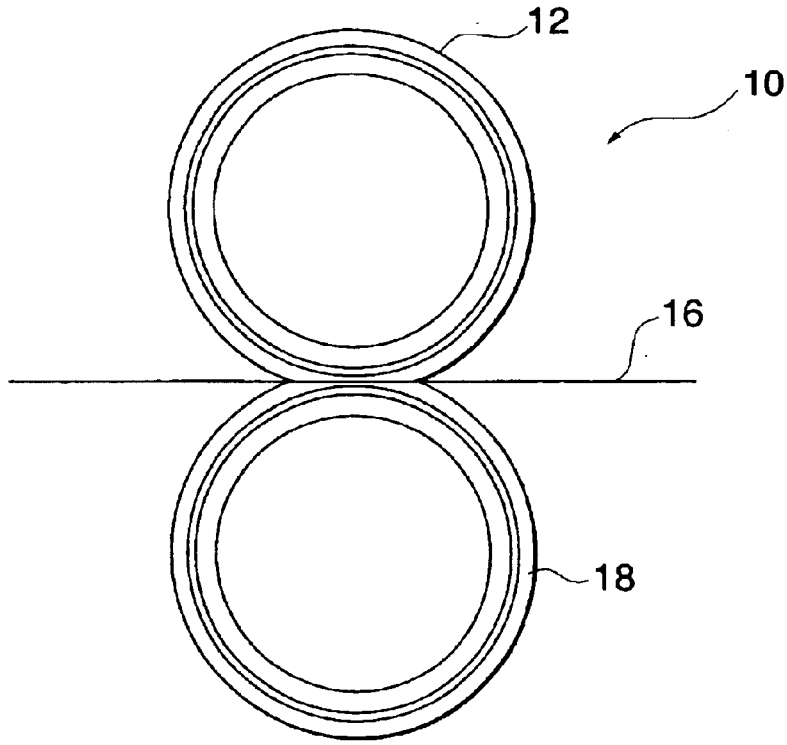
FIG. 2 is a side view showing another example of a fixing device including a heat roller according to the present invention.

FIG. 2 is a side view showing a fixing device including a heat roller according to another embodiment of the present invention. A fixing device 10 includes a heat roller 12 and a heat roller 18, serving as a pressure roller, that is pressed into contact with the heat roller 12. The heat roller 18 has a configuration similar to that of the heat roller 12. In this case, a toner carried by the sheet 16 is melted by heat generated by the heat rollers 12 and 18 and is pressurized to be fixed.

Figure 3:
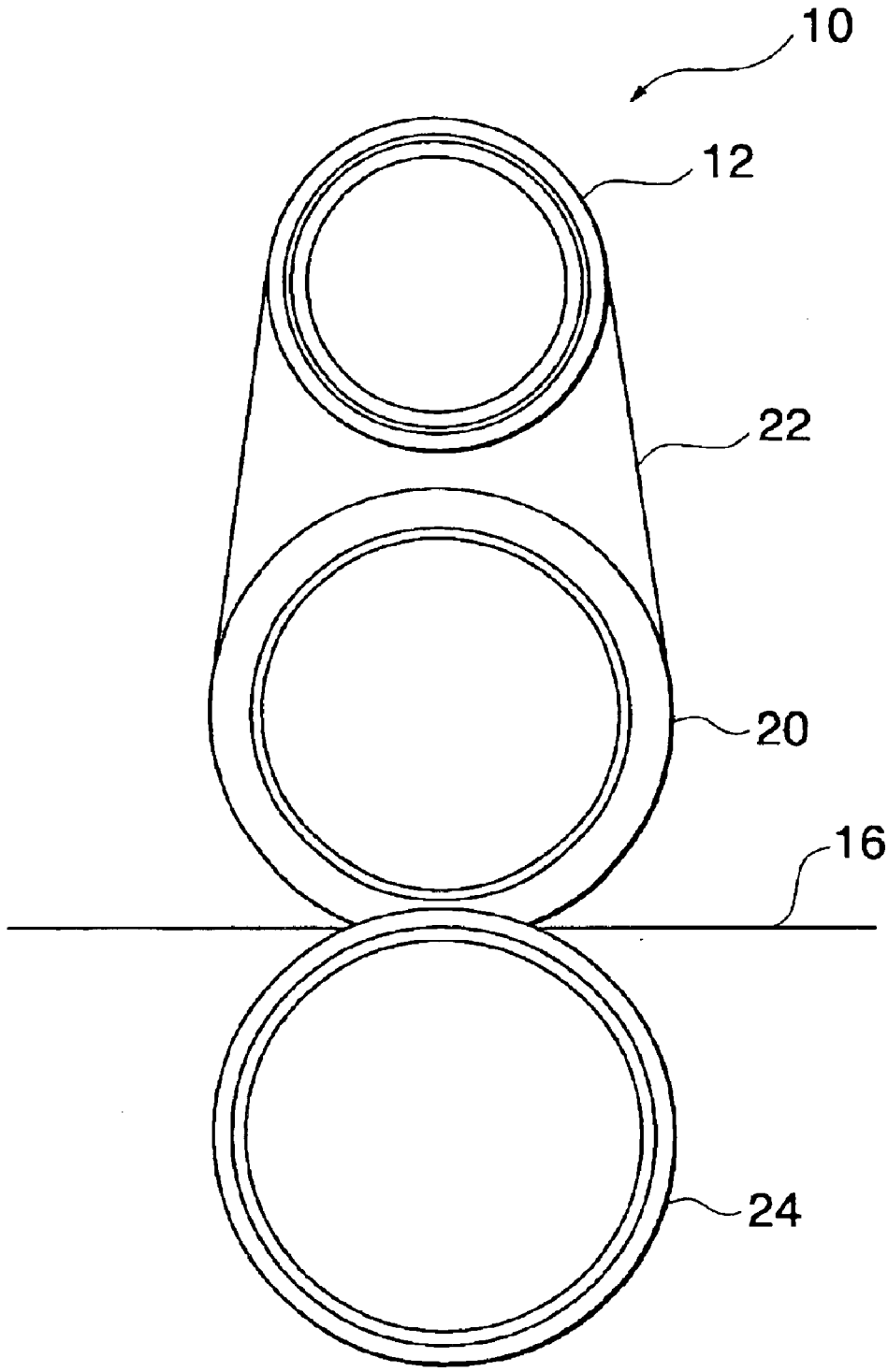
FIG. 3 is a side view showing another example of a fixing device including a heat roller according to the present invention.

FIG. 3 is a side view showing another example of a fixing device including the heat roller according to the present invention. A fixing device 10 has the heat roller 12, fixing roller 20, belt 22 bridged to the heat roller 12 and the fixing roller 20 and a pressure roller 24 that is pressed in contact with the fixing roller 20 via the belt 22. In this case, heat generated by the heat roller 12 is transmitted to the sheet 16 via the belt 22, whereby toner carried by the sheet 16 is melted by the heat generated by the heat roller 12, pressurized, and then, fixed. A heat roller can be used instead of the pressure roller 24.

Figure 4:
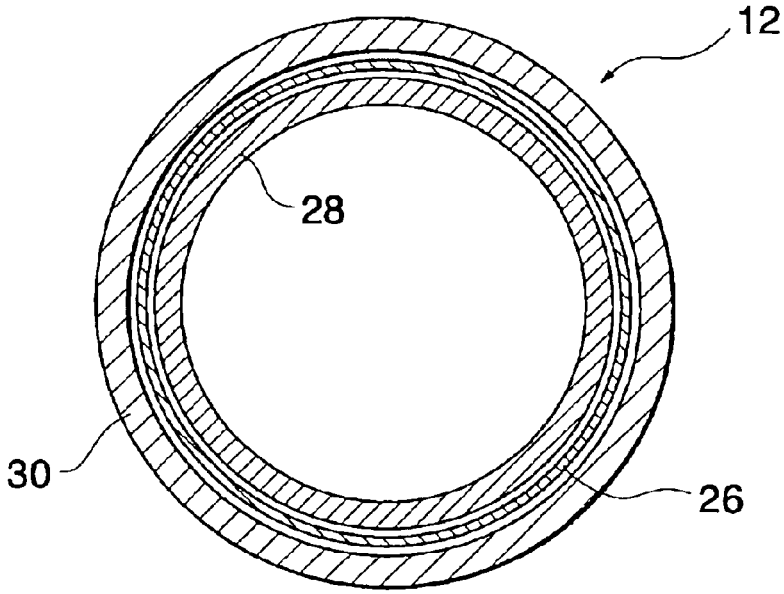
FIG. 4 is a sectional view showing a heat roller before tube expansion.
Figure 5:
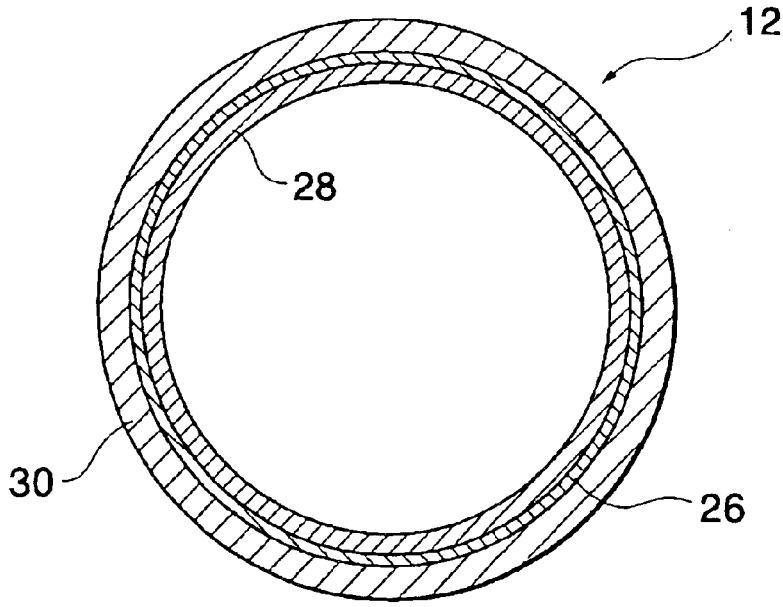
FIG. 5 is a sectional view showing a heat roller after the tube expansion.

FIGS. 4 and 5 are sectional views each showing the heat roller 12 shown in FIGS. 1 to 3. FIG. 4 shows the heat roller 12 before the tube expansion (during the fabrication process), while FIG. 5 shows the heat roller 12 after the tube expansion. In FIG. 5, the heat roller 12 includes the cylindrical sheet-like heating element 26, the inner tube 28 that comes in intimate contact with the inner surface of the sheet-like heating element 26 and the outer tube 30 that comes in intimate contact with the outer surface of the heating element 26. In FIG. 4, a gap is present between the sheet-like heating element 26 and the inner tube 28 and a gap is present between the sheet-like heating element 26 and the outer tube 30.

Figure 6:
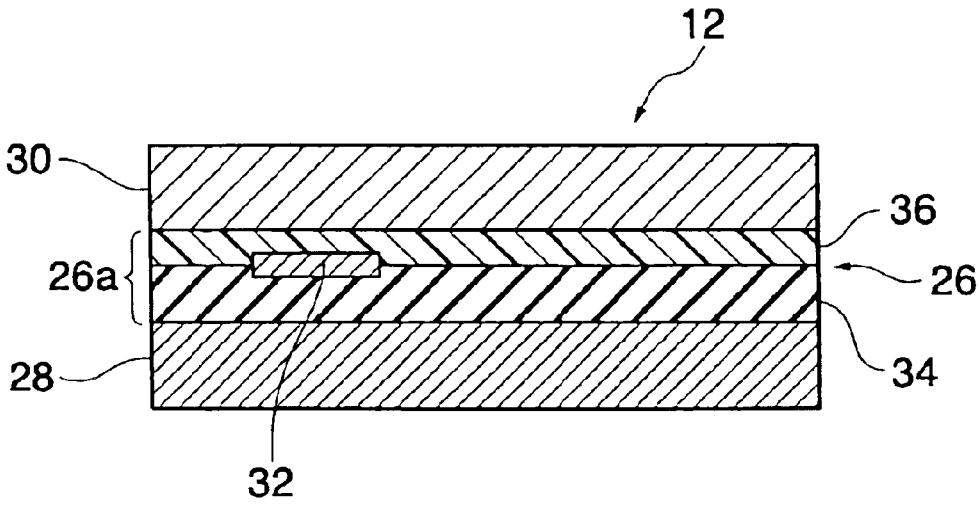
FIG. 6 is a sectional view showing a heat roller taken along a line VI—VI in FIG. 7.
Figure 7:
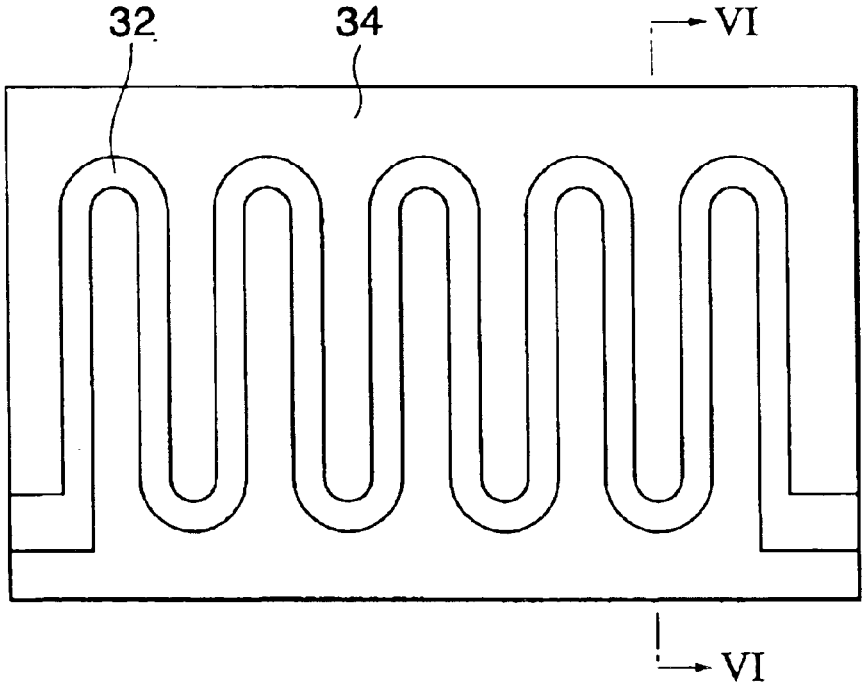
FIG. 7 is a plan view showing a pattern of a resistance member of a heating sheet.

FIG. 6 is a sectional view showing the heat roller 12 taken along a line VI—VI in FIG. 7. The sheet-like heating element 26 has a heating sheet 26*a* wherein a resistance member 32 is embedded in insulating members 34 and 36. The resistance member 32 is formed on the insulating member 34 and covered with the insulating member 36. For example, the insulating members are made of a polyimide type heat-resistant resin and the resistance member 32 is made of stainless steel. The heating sheet 26*a* is formed as a flat sheet. It is rounded to join both ends of the sheet, to thereby be formed into the cylindrical sheet-like heating element 26. The inner tube 28 is made of a relatively soft aluminum type material so as to be deformable while the outer tube 30 is made of a relatively hard aluminum type material such that the heat roller 12 keeps the cylindrical shape.

FIG. 7 is a plan view showing a pattern of the resistance member 32 on the insulating member 34 of the heating sheet 26*a*. The resistance member 32 is formed on the insulating member 34 so as to meander. The insulating member 36 is laminated on the insulating member 34 having the resistance member 32 formed thereon. Electric current flows through both ends of the resistance member 32, so that the resistance member 32 generates heat, and the generated heat is transmitted to the sheet 16 via the outer tube 30.

Figure 8:
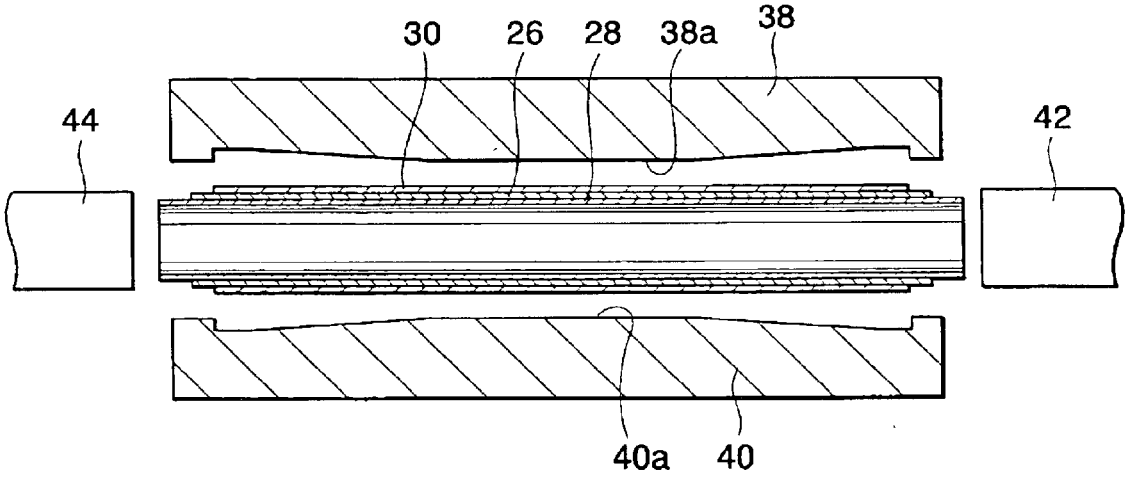
FIG. 8 is a sectional view showing a step of a fabrication method of a heat roller before tube expansion.
Figure 9:
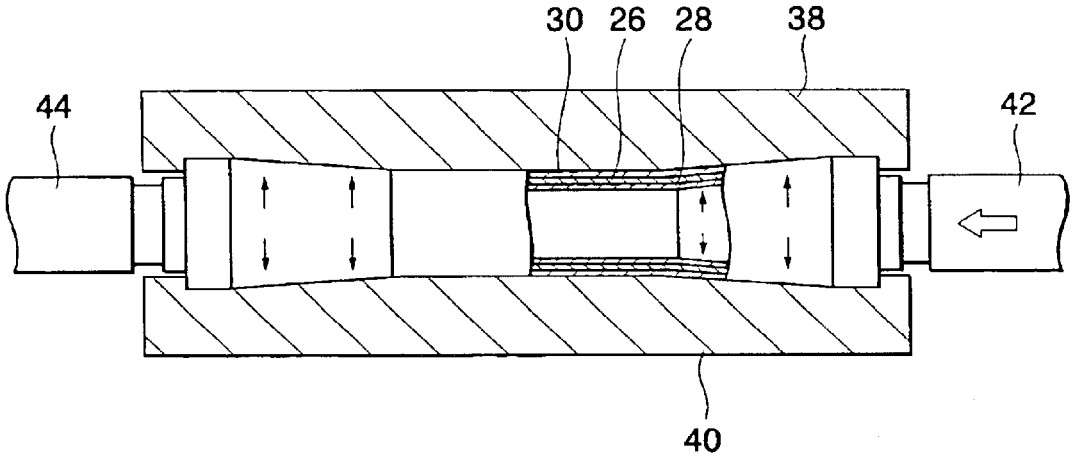
FIG. 9 is a sectional view showing a tube expansion step of a fabrication method of a heat roller.

FIGS. 8 and 9 are sectional views showing a fabrication process of the heat roller 12. FIG. 8 shows a step before the tube expansion while FIG. 9 shows a tube expansion step. In FIG. 8, an outer shape die for tube expansion formed of an upper die 38 and lower die 40 is prepared. The outer shape die for tube expansion formed of an upper die 38 and lower die 40 has non-linear inner shapes 38*a* and 40*a*. Further, a pressurized fluid supplying tube 42 and a pressurized fluid discharging tube 44 are prepared.

A heat roller assembly having the cylindrical sheet-like heating element 26, inner tube 28 and outer tube 30 is inserted into the outer shape die for tube expansion having the upper die 38 and the lower die 40. As shown in FIG. 4, the inner tube 28 is arranged at the inside of the sheet-like heating element 26 while the outer tube 30 is arranged at the outside thereof. At this time, a gap may be formed between the sheet-like heating element 26 and the inner tube 28 and a gap may be formed between the sheet-like heating element 26 and the outer tube 30, whereby the heat roller assembly can easily be assembled. It is to be noted that the sheet-like heating element 26 may be in partial contact with the inner tube 28 and with the outer tube 30.

In FIG. 9, the pressurized fluid supplying tube 42 and the pressurized fluid discharging tube 44 are connected to the edge section of the inner tube 28, and then, the upper die 38 and the lower die 40 are brought close to each other to close the outer shape die for tube expansion.

Pressurized fluid (e.g., water) is supplied into the inner tube 28 from the pressurized fluid supplying tube 42 with a pressure of 60 $Kg/cm^2$. Then, the inner tube 28 is expanded and brought into intimate contact with the sheet-like heating element 26 to thereby expand the sheet-like heating element 26, whereby the sheet-like heating element 26 is brought into intimate contact with the outer tube 30 to thereby expand the outer tube 30. The expansion of the outer tube 30 is restricted by the outer shape die for tube expansion formed of the upper die 38 and the lower die 40. As described above, the heat roller assembly including the sheet-like heating element 26, inner tube 28 and outer tube 30 is expanded toward the outer shape die for tube expansion, with the result that the inner tube 28 is brought into intimate contact with the sheet-like heating element 26 and the sheet-like heating element 26 is brought into intimate contact with the outer tube 30, and further, the outer tube 30 is formed so as to match with the inner shape of the outer shape die for tube expansion.

As shown in FIG. 8, the inner shapes 38*a* and 40*a* of the upper die 38 and the lower die 40 are formed into a crown shape in which a center section in the longitudinal direction rises.

Figure 10:
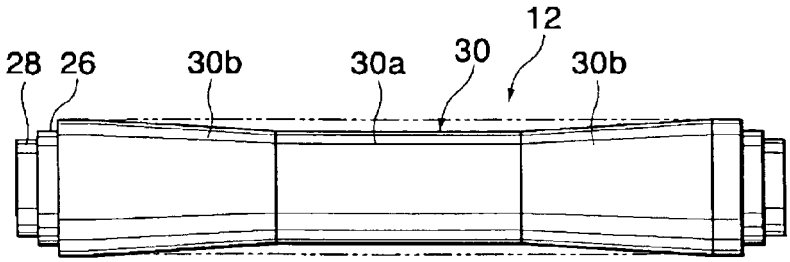
FIG. 10 is a front view showing a heat roller fabricated by the fabrication method of the heat roller in FIGS. 8 and 9.

FIG. 10 is a front view showing the heat roller 12 fabricated by the fabrication process of the heat roller shown in FIGS. 9 and 10. The outer tube 30 formed by the outer shape die having a crown-shaped cavity is formed into a reverse-crown shape. The outer tube 30 has a small-diameter section 30*a* at its center and a taper section 30*b* whose diameter is widened toward the edge section from the small-diameter section 30*a* at the center. Specifically, the outer tube 30 has a non-linear shape in the axial direction. In the present invention, the outer tube 30 is not formed such that only the outer surface of the outer tube 30 is formed into the reverse-crown shape like the case where the outer surface of the outer tube 30 is cut by a turning machine, but formed such that the inner surface of the outer tube 30 is also formed into the reverse-crown shape.

A broken line represents a cylindrical surface connecting both edge sections of the outer tube 30. The difference between the diameter of the small-diameter section 30*a* at the center of the outer tube 30 and the diameter of both edge sections of the outer tube 30 of the heat roller 12 does not necessarily have to be so great. For example, if the length of the heat roller 12 is approximately 350 mm, the difference between the diameter of the small-diameter section 30*a* and the diameter of both edge sections may be about 0.1 mm. The heat roller 12 formed into a reverse-crown shape can prevent the sheet 16 from being wrinkled or can prevent that the pressure distribution in the axial direction becomes non-uniform. In this way, the directly-heated heat roller 12 including the sheet-like heating element 26 and having a reverse-crown shape can easily be fabricated. In particular, assembling and tube expansion of the directly-heated heat roller 12 can be performed simultaneously with the formation of the outer shape, thereby being capable of accomplishing remarkably reduced cost.

Figure 11:
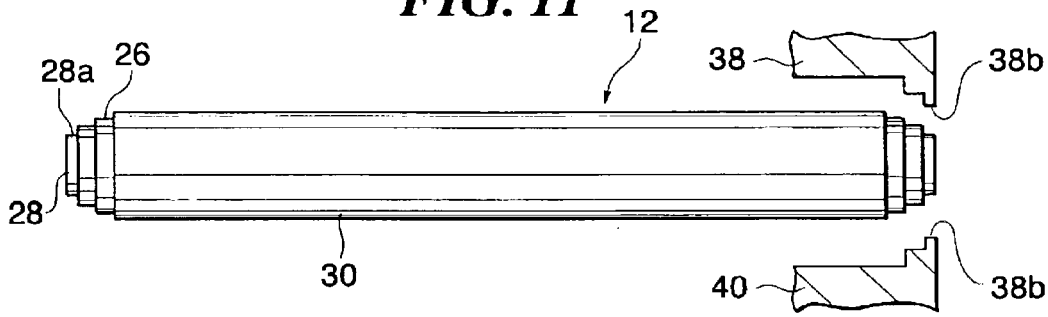
FIG. 11 is a front view showing another embodiment of a heat roller according to the present invention.

FIG. 11 is a front view showing a heat roller according to another embodiment of the present invention. The heat roller 12 includes, as explained with reference to FIGS. 4 to 7, the sheet-like heating element 26, inner tube 28 and outer tube 30. The heat roller 12 is, as explained with reference to FIGS. 8 and 9, fabricated in the same manner using the outer shape die formed of the upper die 38 and the lower die 40. The upper die 38 and the lower die 40 are partially represented in FIG. 11.

Provided at the edge section of the upper die 38 and the lower die 40 are step sections 38*b* and 40*b* formed of a convex section and concave section. Accordingly, the heat roller 12 is formed according to the outer shape die for tube expansion with the upper die 38 and the lower die 40 and a step section 28*a* having a convex section and concave section is formed at the edge section of the inner tube 28 at the edge section of the heat roller 12, when the heat roller 12 is fabricated in a manner as explained with reference to FIGS. 8 and 9. A bearing, for example, can be attached to this step section 28*a*. An external electrode can also be attached to this step section 28*a*, for example. The outer tube 30 is preferably formed into a reverse-taper shape, but it may have a cylindrical shape.

Figure 12:
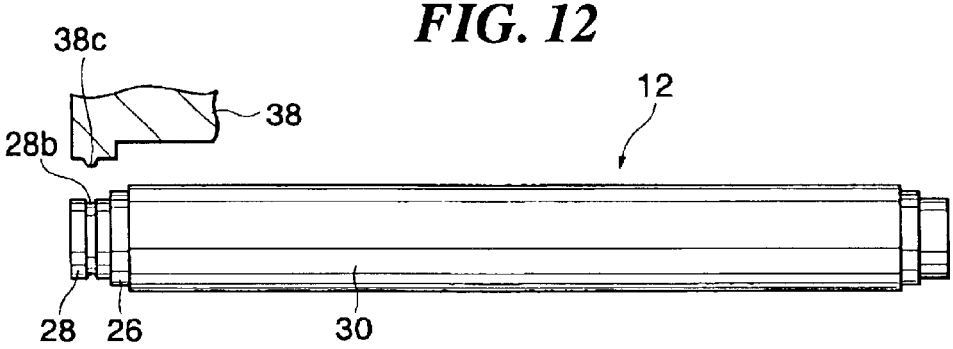
FIG. 12 is a front view showing a modified example of the heat roller shown in FIG. 11.

FIG. 12 is a front view showing a modified example of the heat roller shown in FIG. 11. In this example, the outer shape die formed of the upper die 38 and the lower die 40 is used as explained with reference to FIGS. 8 and 9. In FIG. 12, only the upper die 38 is represented. The upper die 38 has a convex section 38*c* at its edge section. Accordingly, the heat roller 12 is formed according to the outer shape die for tube expansion composed of the upper die 38 and the lower die 40, and a concave section 28*b* is formed at the edge section of the inner tube 28 at the edge section of the heat roller 12. An O-ring, an E-ring or a snap ring, for example, can be attached to this concave section 28*b*.

Figure 13:
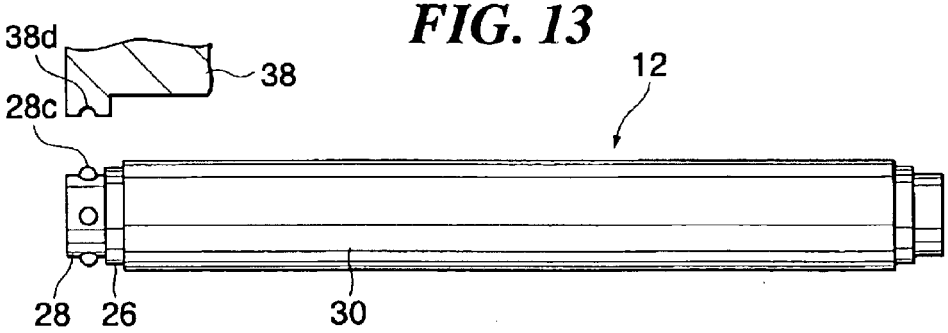
FIG. 13 is a front view showing a modified example of the heat roller shown in FIG. 11.

FIG. 13 is a front view showing a modified example of the heat roller shown in FIG. 11. In this example, the outer shape die formed of the upper die 38 and the lower die 40 is used as explained with reference to FIGS. 8 and 9. In FIG. 13, only the upper die 38 is represented. The upper die 38 has a concave section 38*d* at its edge section. Accordingly, the heat roller 12 is formed according to the outer shape die for tube expansion with the upper die 38 and the lower die 40, and a convex section 28*c* is formed at the edge section of the inner tube 28 at the edge section of the heat roller 12. This convex section 28*c* can be used, for example, as a stopper for attaching a ring member such as a snap ring.

Figure 14:
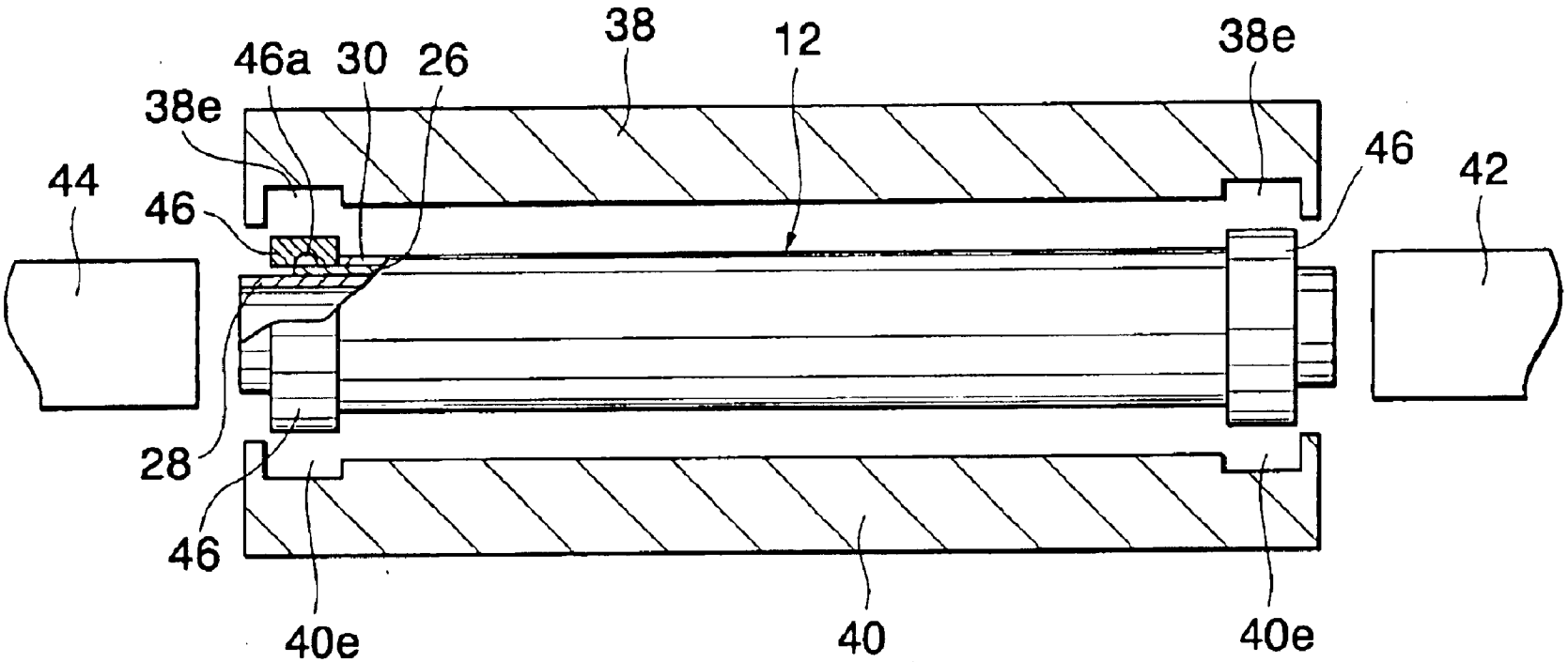
FIG. 14 is a sectional view showing a step of a fabrication method of a heat roller before tube expansion in another example.
Figure 15:
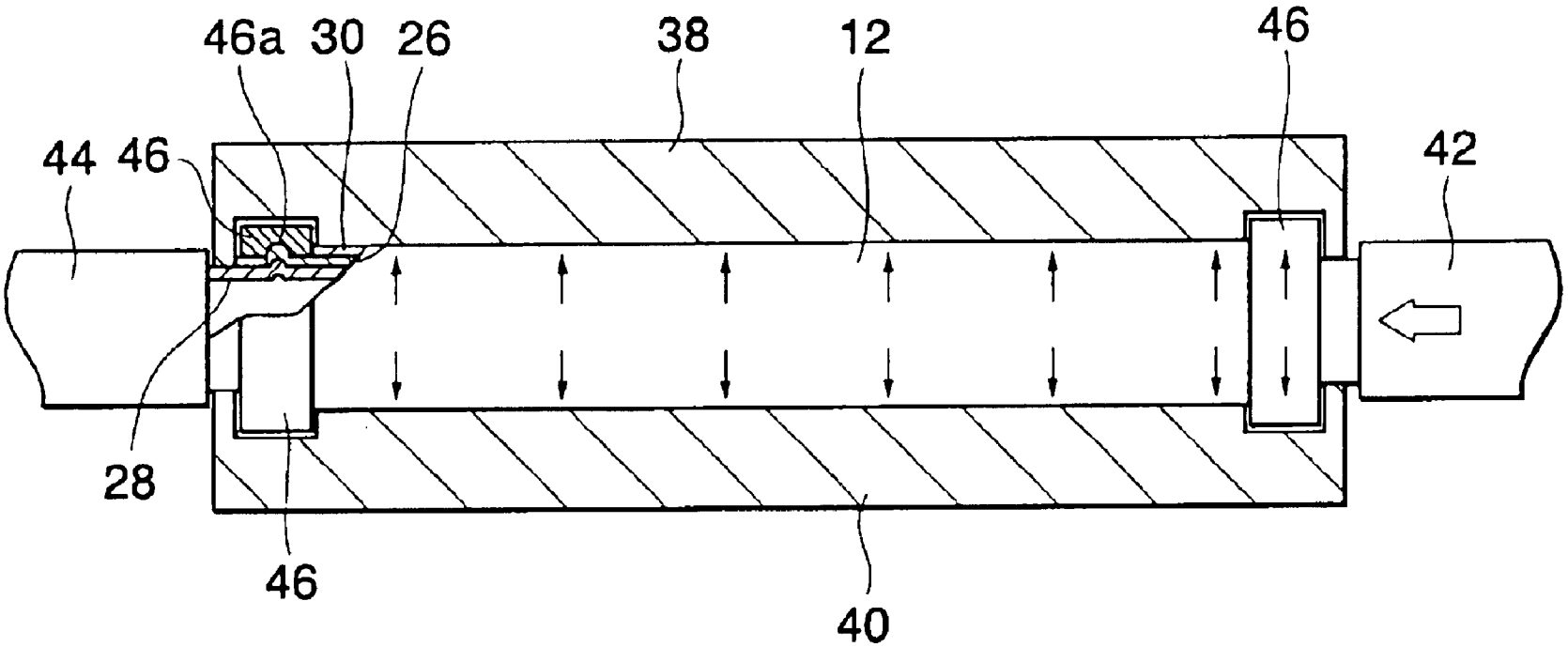
FIG. 15 is a sectional view showing a tube expansion step of a fabrication method of a heat roller.
Figure 16:
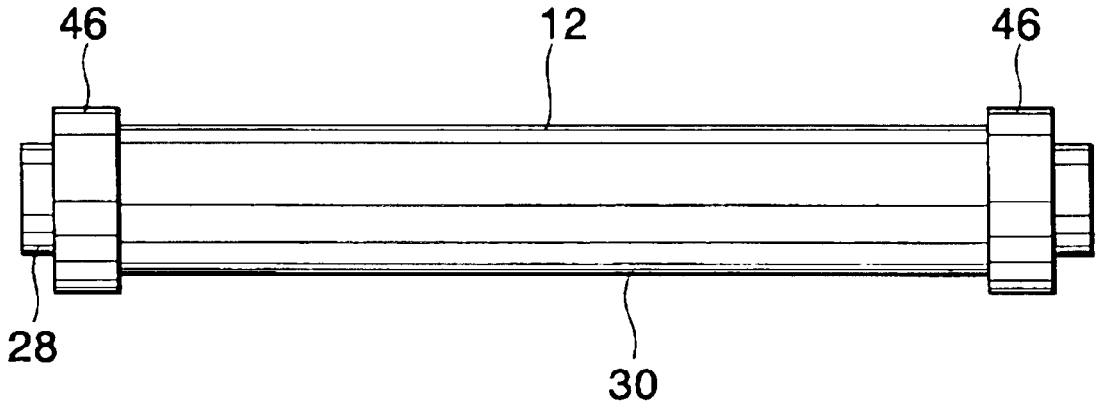
FIG. 16 is a front view showing a heat roller fabricated by the fabrication method of the heat roller in FIGS. 14 and 15.

FIG. 14 is a sectional view showing a step before the tube expansion of the fabrication process of the heat roller according to another example. FIG. 15 is a sectional view showing a tube expansion step of the fabrication process of the heat roller. FIG. 16 is a front view showing the heat roller fabricated by the fabrication process of the heat roller shown in FIGS. 14 and 15. The heat roller 12 includes the sheet-like heating element 26, inner tube 28 and outer tube 30 as explained with reference to FIGS. 4 to 7. The heat roller 12 is fabricated in the same manner using the outer shape die for tube expansion with the upper die 38 and the lower die 40, as explained with reference to FIGS. 8 and 9.

In this example, a flange (ring member) 46 is fitted to the exposed edge section of the sheet-like heating element 26 of the heat roller 12. The upper die 38 and the lower die 40 have concave sections 38*e* and 40*e* at the position corresponding to the flange 46. The flange 46 is made separate from the heat roller 12 with a resinous material or a metallic material, and attached to the heat roller 12. The flange 46 has a concave section 46*a* at the inside thereof.

Therefore, when pressurized fluid is supplied to the inner tube 28, a part of the inner tube 28 and the sheet-like heating element 26 is fitted into the concave section 46*a* of the flange 46, so that the flange 46 is fixed to the heat roller 12. Specifically, the heat roller 12 is formed according to the outer shape die for tube expansion with the upper die 38 and the lower die 40, and the flange 46 can be fixed to the heat roller 12. The flange 46 can be used for various objects. For example, a gear can be attached to the flange 46. Alternately, the flange 46 may be a part of a conductive member for electrically connecting the resistance member 32 of the sheet-like heating element 26 and a power source.

As explained above, the present invention can provide various heat rollers each having various outer shape specification with low cost. Further, the present invention can provide a heat roller capable of reducing processing cost for performing positioning or fixation in installing an external electrode, bearing, flange and the like.

What is claimed is:

1. A heat roller comprising a cylindrical sheet-like heating element having a resistance member embedded in an insulating member, an inner tube that comes in intimate contact with an inner surface of the sheet-like heating element and an outer tube that comes in intimate contact with an outer surface of the sheet-like heating element, wherein the outer tube has a non-linear shape seen in an axial direction.

2. The heat roller according to claim 1, wherein the outer tube is preferably formed into a reverse-crown shape seen in the axial direction.

3. A method of fabricating a heat roller comprising a cylindrical sheet-like heating element having a resistance member embedded in an insulating member, an inner tube that comes in intimate contact with an inner surface of the sheet-like heating element and an outer tube that comes in intimate contact with an outer surface of the sheet-like heating element, comprising:

arranging the inner tube on the inner surface side of the sheet-like heating element;

arranging the outer tube on the outer surface side of the sheet-like heating element;

inserting the inner tube, sheet-like heating element and outer tube into a die having a non-linear inner shape seen in an axial direction; and supplying pressurized fluid to the inner tube to expand the inner tube, sheet-like heating element and outer tube toward the die for forming the outer tube so as to match with the inner shape of the die.

4. A method of fabricating a heat roller comprising a cylindrical sheet-like heating element having a resistance member embedded in an insulating member, an inner tube that comes in intimate contact with an inner surface of the sheet-like heating element and an outer tube that comes in intimate contact with an outer surface of the sheet-like heating element, comprising:

arranging the inner tube on the inner surface side of the sheet-like heating element;

arranging the outer tube on the outer surface side of the sheet-like heating element;

inserting the inner tube, sheet-like heating element and outer tube into a die having a convex section or a concave section at its edge section; and supplying pressurized fluid to the inner tube to expand the inner tube, sheet-like heating element and outer tube toward the die for forming the edge section of the inner tube into a shape having a convex section or a concave section corresponding to the convex section or the concave section of the die.

5. A method of fabricating a heat roller comprising a cylindrical sheet-like heating element having a resistance member embedded in an insulating member, an inner tube that comes in intimate contact with an inner surface of the sheet-like heating element and an outer tube that comes in intimate contact with an outer surface of the sheet-like heating element comprising:

arranging the inner tube on the inner surface side of the sheet-like heating element;

arranging the outer tube on the outer surface side of the sheet-like heating element;

inserting the inner tube, sheet-like heating element and outer tube into a die, arranging a ring member at an edge section of the inner tube, and supplying pressurized fluid to the inner tube to expand the inner tube, sheet-like heating element and outer tube toward the die for forming the edge section of the inner tube so as to match with the inner shape of the die and the ring member is fixed to the edge section of the inner tube.

* * * * *